US005201575A

United States Patent [19]

Stolzel

[11] Patent Number: 5,201,575

[45] Date of Patent: Apr. 13, 1993

[54] CONTAINER STORAGE CABINET

[76] Inventor: Peter Stolzel, 613 Mary Street North, Oshawa, Ontario, Canada, L1G 5E8

[21] Appl. No.: 811,053

[22] Filed: Dec. 20, 1991

[51] Int. Cl.[5] ..... A47B 88/18

[52] U.S. Cl. ..... 312/323; 312/348.3

[58] Field of Search ..... 312/323, 32, 111, 183, 312/348.3

[56] References Cited

U.S. PATENT DOCUMENTS

| | | | |
|---|---|---|---|
| 689,588 | 12/1901 | Hoult . | |
| 776,736 | 12/1904 | Greenen . | |
| 1,009,141 | 11/1911 | Faust . | |
| 1,360,086 | 11/1920 | Braekke et al. . | |
| 2,344,168 | 3/1944 | Regenhardt . | |
| 2,423,919 | 9/1947 | Wolters . | |
| 2,839,349 | 6/1958 | Culver . | |
| 2,918,342 | 12/1959 | Tarte . | |
| 3,311,438 | 3/1967 | Barrow . | |
| 4,314,734 | 2/1982 | Grunert . | |
| 4,441,771 | 4/1982 | Roesler . | |
| 4,461,388 | 7/1984 | Bustos | 211/184 |
| 4,577,914 | 3/1986 | Stravitz | 312/111 X |

FOREIGN PATENT DOCUMENTS

| | | | |
|---|---|---|---|
| 120765 | 8/1927 | Switzerland . | |
| 6732 | of 1903 | United Kingdom . | |
| 705348 | 8/1952 | United Kingdom | 312/323 |

*Primary Examiner*—Peter R. Brown

[57] ABSTRACT

A container for storing cylindrical articles in a readily accessible manner, comprising an open ended channel shaped cabinet body having a bottom and two side walls and rails upstanding from said cabinet body bottom and extending longitudinally thereof; a drawer slidable in said cabinet body on the rails and having a front end, a back wall, a bottom, and side walls upstanding from the bottom; and cooperating pivoting structure located near the front of said cabinet body and the rear of said drawer to permit a hinging-like rotation of the drawer on the body, whereby to enable the drawer to hang downwardly from the front end of said body for article handling, said cooperating pivoting structure comprising an upstanding, inwardly directed flange member at the front edge of each cabinet body side wall, and a ledge member extending beneath the drawer bottom and outwardly of each of the drawer side walls, said flanges and ledges cooperating to permit said hinging-like rotation, to enable said drawer to hang substantially vertically downwardly.

19 Claims, 5 Drawing Sheets

CONTAINER STORAGE CABINET

BACKGROUND OF THE INVENTION

The present invention relates to a container for storing articles in a readily accessible manner.

Attention is directed to solutions of storage problems in different fields.

In U.S. Pat. No. 2,839,349 there is described a knife drawer unit which can be attached to the underside of a high kitchen cabinet. The drawer can be moved forward and then tilted about pivots to provide access to the knives stored in the drawer.

In U.S. Pat. No. 4,314,734 there is described a cabinet drawer which can pivot into an inclined position when opened, to make the tools, small appliances, parts and the like within the drawers more visible and accessible and permits the use of higher storage cabinets in certain instances.

In U.S. Pat. No. 3,311,439 there is described a filing cabinet which, upon being withdrawn from the cabinet may be pivoted to a vertical position to provide access to the documents and drawings stored therein.

The storage art is replete with card index cabinets, phonograph storage cabinets, cabinets for small articles and cabinets suitable for card indexes, see for example U.S. Pat. Nos. 2,423,919; 1,009,141; 689,588; and 2,344,168 among others.

SUMMARY OF THE INVENTION

In its broadest aspect the invention consists of a container for storing articles in a readily accessible manner, comprising: an open ended channel shaped cabinet body having a bottom and two side walls, and rail means upstanding from said cabinet body bottom and extending longitudinally thereof; a drawer slidable in said cabinet body on said rails and having a front end, a back wall, a bottom, and side walls upstanding from the bottom; and cooperating pivoting means located near the front of said cabinet body and the rear of said drawer to permit a hinging-like rotation of the drawer on the body, whereby to enable the drawer to hang downwardly from the front end of said body for article handling, said cooperating pivoting means comprising an upstanding, inwardly directed flange member at the front edge of each cabinet body side wall, and a ledge member extending beneath the drawer bottom and outwardly of each of the drawer side walls, said flanges and ledges cooperating to permit said hinging-like rotation, to enable said drawer to hang substantially vertically downwardly.

Preferably the container includes means mounted on the drawer for retaining articles stored therein. One such means, for retaining cylindrical articles, comprises a plurality of resilient article retaining inverted U-shaped rib members each bridging said shallow side walls and upstanding therefrom and spaced therealong from said back wall at intervals approximately the diameter of a selected cylindrical article to be retained in the drawer and spanning said drawer at a height above the bottom thereof slightly less than the diameter of the selected cylindrical article, whereby to provide a series of article receiving open pockets along said drawer, the rib defining the pocket adjacent the back wall being spaced therefrom a distance slightly less than the diameter of the selected cylindrical article, the front end of the drawer having an inturned lip.

BRIEF DESCRIPTION OF THE DRAWINGS

The following is a description by way of example of one embodiment of the present invention, reference being had to the accompanying drawings in which.

DESCRIPTION OF THE PREFERRED EMBODIMENT

Figure 1:
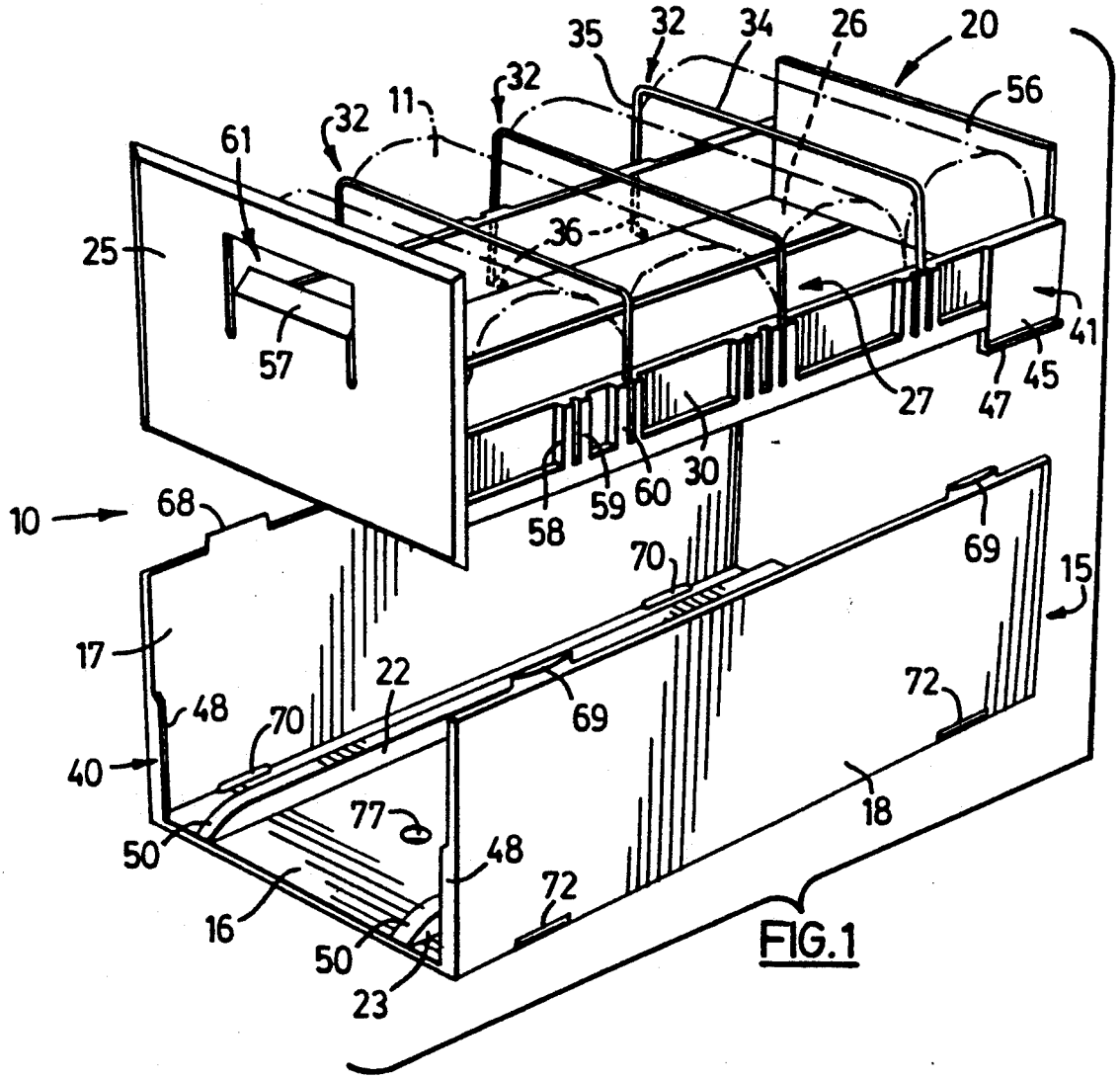
FIG. 1 is an exploded perspective view of the cabinet body and its drawer.

In the example embodiment shown in FIGS. 1 to 9 of the drawings a container 10 for storing cylindrical articles 11, such as cans of food and the like, has an open channel shaped cabinet body 15 having a bottom 16 and two upstanding side walls 17 and 18. A drawer 20 is slidably mounted in the cabinet body 15 on a pair of longitudinally extending rails 22, 23 upstanding from the bottom 16 of the cabinet body 15. The drawer has a front end 25, and a bottom 26 (only one-half of which is shown in FIG. 1) divided in two by a centrally extending longitudinal slot 27.

Upstanding from each half of the bottom 26 is a shallow side wall 30.

A plurality of article retaining rib members 32, here shown in the form of substantially U-shaped spring wires having substantially flat tops 34 and depending side arms 35 with inwardly directed hooks 36 at their free ends, are spaced along the drawer behind the front end 25 at intervals, slightly less than the diameter of the individual can 11 being retained between a pair of rib members 32 and provide a series of open pockets therebetween.

Figure 2:
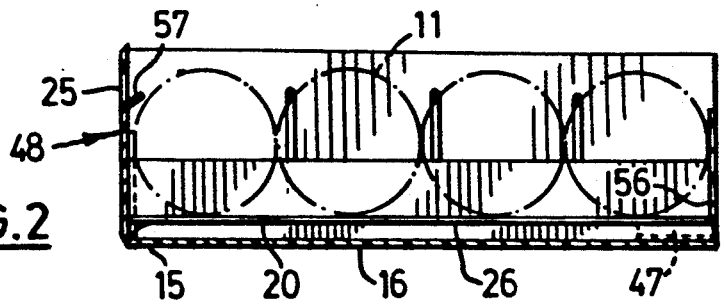
FIG. 2 is a side section of the drawer of FIG. 1 in closed position storing cylindrical articles all of one selected diameter.
Figure 3:
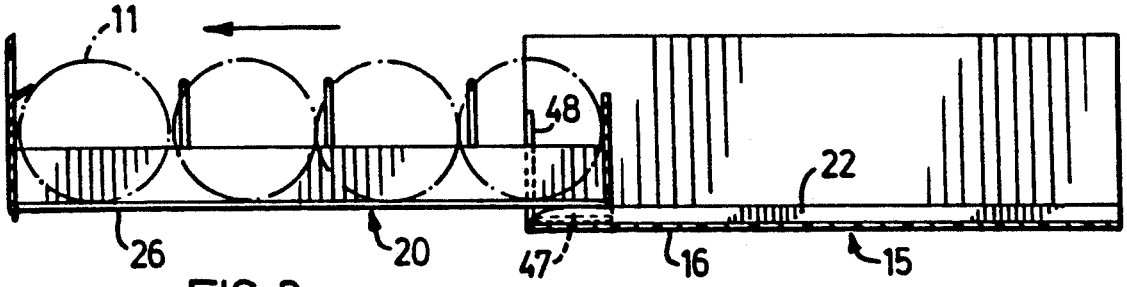
FIG. 3 is a view similar to FIG. 1 but with the drawer partially pulled out from the cabinet body.
Figure 4:
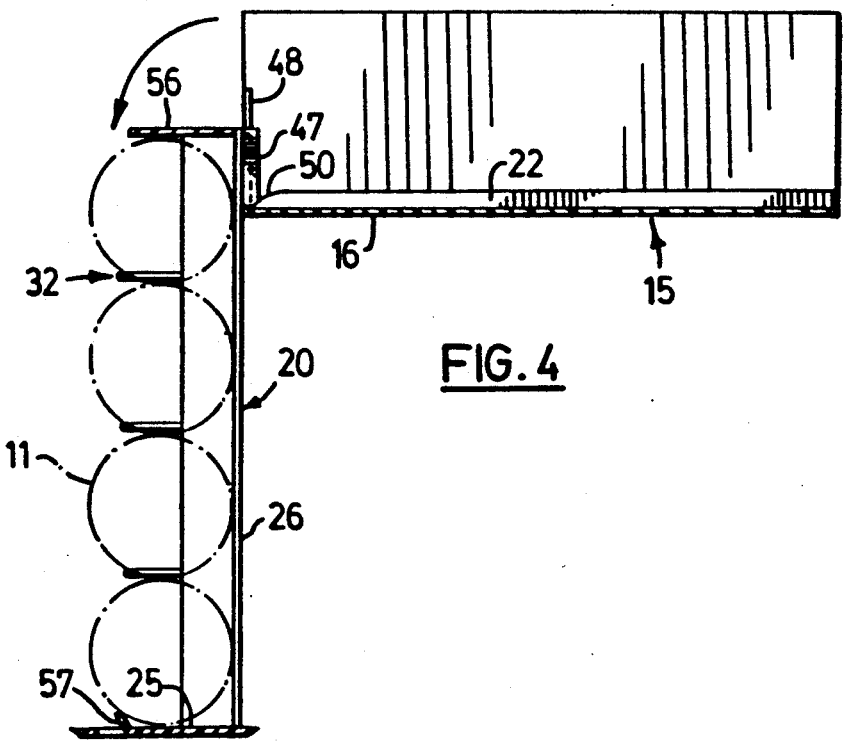
FIG. 4 is a view similar to FIG. 1 but with the drawer fully withdrawn from the cabinet body and rotated to the vertical position.
Figure 5:
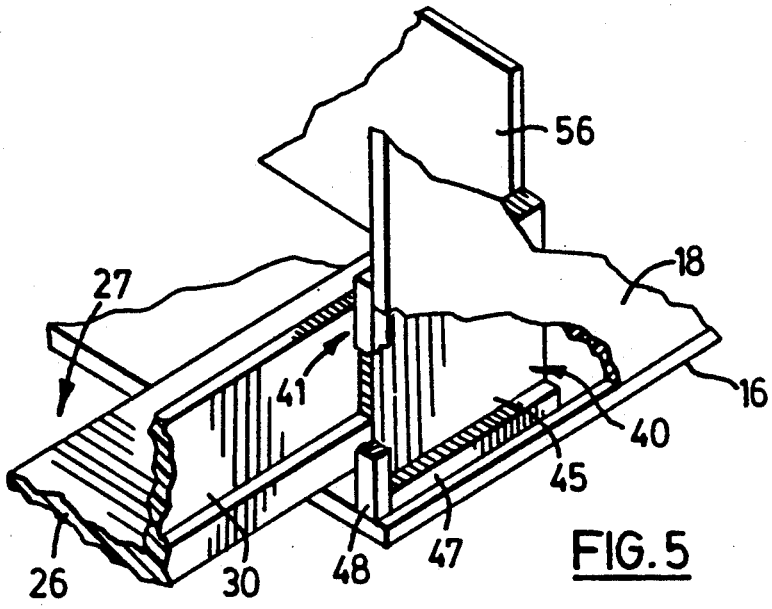
FIGS. 5 and 6 are details of the cooperating pivoting means near the front of the cabinet body and the rear of the drawer.
Figure 6:
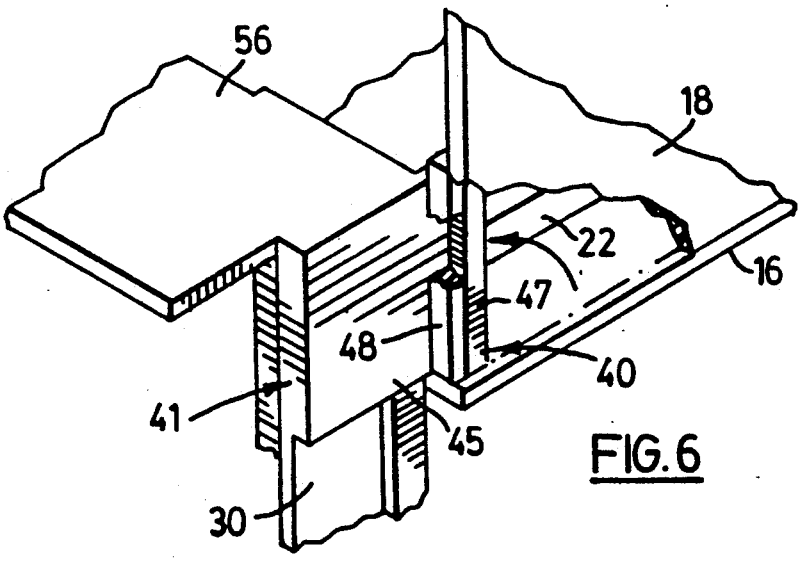

As best seen in FIGS. 2, 3 and 4, when the drawer 20 is fully withdrawn from the cabinet body 15 it is capable of hinging-like rotation on the body 15 to hang vertically downward, as seen in FIG. 4. In order to permit this hinging-like rotation, cooperating hinging means 40, 41 (best seen in FIGS. 5 and 6) are provided at the rear of the drawer 20 and at the front of the cabinet body 15, respectively. The hinging member 40, as shown, takes the form of a downwardly directed tab 45 extending beneath the drawer's bottom 26 on either side of the side walls and terminating in an outwardly extending ledge 47. Element 41, as shown, is an upwardly and inwardly directed flange member 48 against which the ledge 47 abuts.

As seen in FIGS. 1, 2 and 3 the rails 22 have downwardly curved ramped ends 50. These curved ramped ends assist the hinging-like rotation as the bottom 26 of the drawer comes to the end of the rails 22.

In the vertical position shown in FIG. 4, the ledge 47 firmly abuts the flanges 48 on either side of the front of the cabinet and firmly retains the drawer in position to permit the user to readily remove cans from the drawer by forcing them free of the wires 32.

Drawer 20 has a back wall 56 and the front end 25 has an interior article retaining lip 57. The side walls 30 have a plurality of parallel vertical projections providing rib receiving guideways 58 grouped in spaced pairs along the side walls, one guideway of each pair having an aperture 59 and the other guideway having an aperture 60 at a different vertical location to aperture 59, as seen more particularly in FIG. 7. The distance from back wall 56 to the first pair of holes 59 or 60 is slightly smaller than the distance between succeeding holes 59 or 60. Also, the distance between pairs of holes 60 is progressively less than the distance between pairs of holes 59.

Figure 7:
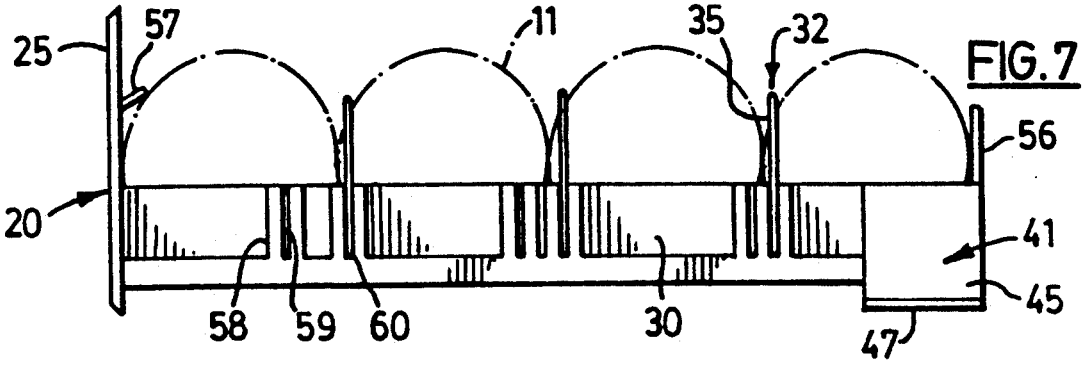
FIG. 7 is a side elevation of the drawer removed from the cabinet body.
Figure 8:
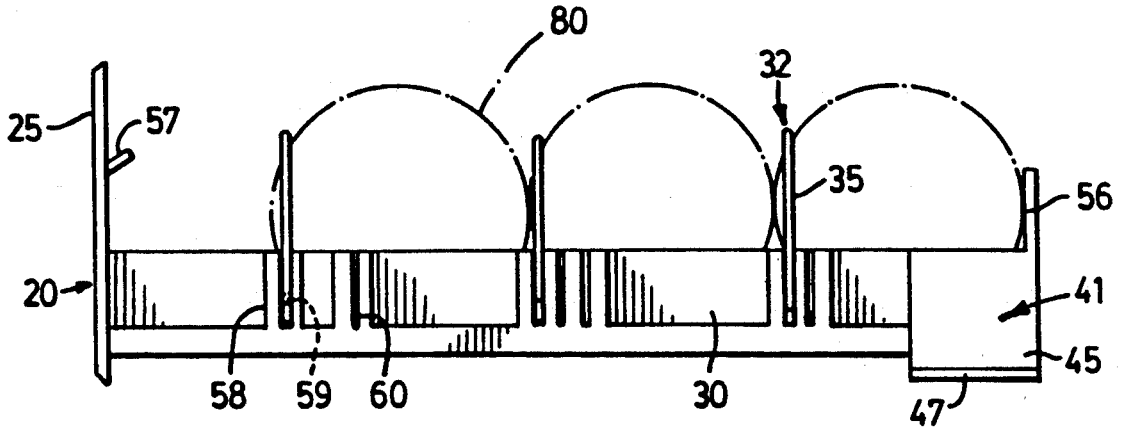
FIG. 8 is a side elevation of the drawer similar to FIG. 7 but storing cylindrical articles of a larger selected diameter.
Figure 9:
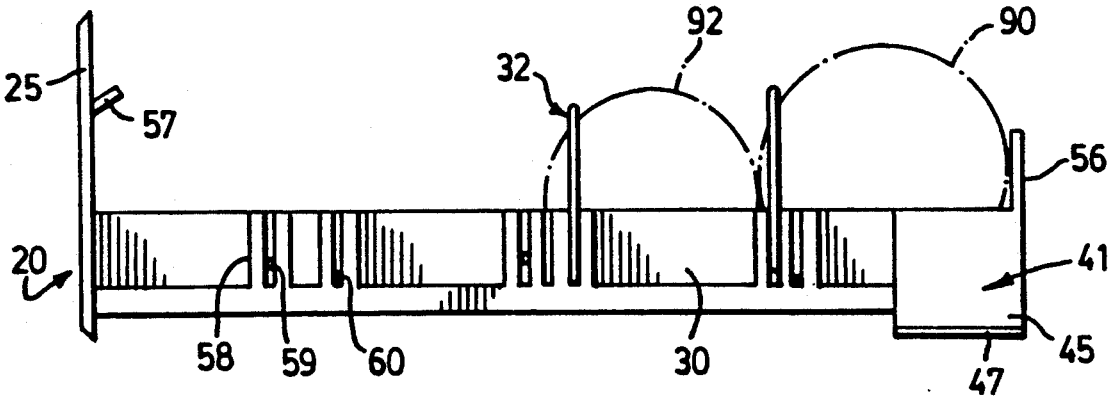
FIG. 9 is a side elevation of the drawer similar to FIG. 8 but storing cylindrical articles of different diameters.

The distance between pairs of guideways 58, and the vertical location of apertures 60, are so chosen that for a given diameter of a series of cans 11, ribs 32 can be located to receive the cans in a snap fit with the leading surface of each can resting against its associated rib and projecting forward under that rib, as seen in FIG. 7. Then as described above, drawer 20 may be withdrawn and rotated to hang downwardly while cans 11 are retained in position, as shown in FIG. 4.

It will be seen that the increase of the width of the pockets defined by ribs 32 could progress from front end 25 to back wall 56 since the ribs would still retain cans 11 in position when drawer 20 hangs downwardly.

The inturned lip 57 provides a finger slot 61 in the front end 25 to permit a user to grasp and operate the drawer with ease. Of course lip 57 could be located instead on the inner side of back wall 56.

To permit containers to be stacked one on top of the other the walls 17 and 18 are provided with upstanding hook members 68, 69 and slots 70 and 72 are provided in the bottom 16 and sides 17 and 18 to receive the hook members 68, 69 so that the container above can be connected to a container below.

If desired the bottom container can be secured to the shelf of the cupboard in which it resides, for example by means of screws inserted through the holes 77 in the bottom 16 of the cabinet body 15.

FIG. 7 shows ribs 32 inserted into apertures 60. In the embodiment shown in FIG. 8 cans 80 of a larger diameter are stored in drawer 20 by inserting ribs 32 in apertures 59. In the embodiment shown in FIG. 9 cans 90 and 92 of different diameters are stored in drawer 20 by inserting one rib 32 in apertures 59 to contain larger can 90 and the other rib 32 in apertures 60 to contain smaller can 92. It will be seen from these example embodiments that drawer 20 may be adapted to retain cylindrical articles of different selected diameters. To increase the versatility of drawer 20 the number guideways 58 may be increased, i.e. the spacing between the guideways may be reduced or eliminated, and the number and location of apertures 59 and 60 may also be increased. Also, guideways 58 could be color coded to assist the user in choosing the proper guideways and apertures to accommodate a given diameter of cylindrical article.

Figure 10:
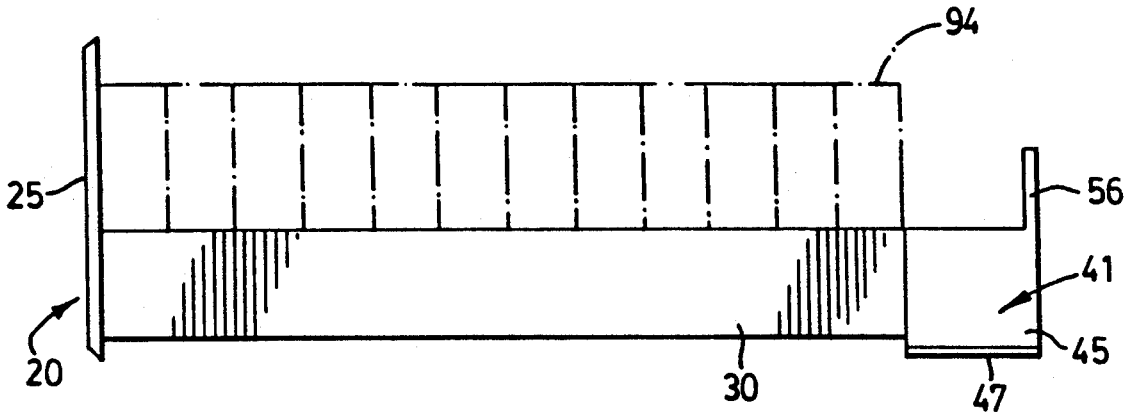
FIG. 10 is a side elevation of a drawer similar to FIG. 7 but storing articles without a restraining member.

The embodiment shown in FIG. 10 shows a drawer of the invention storing articles of a configuration which requires no retaining member, such as audio or video tape cassettes 94.

Figure 11:
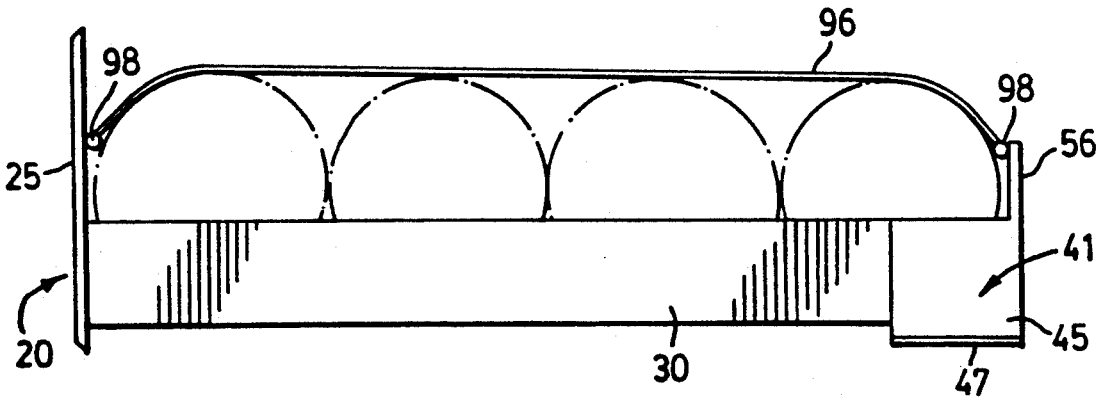
FIG. 11 is a side elevation of a drawer similar to FIG. 7 but having an alternate embodiment of a restraining member.

FIG. 11 of the drawings shows a drawer of the invention including an alternate embodiment of a retaining member comprising an elastic member 96 releasably attached to hooks 98 secured to the inward faces of front end 25 and back wall 56. It will be appreciated that other forms of retaining devices may be used.

It will be appreciated that the container of the invention provides a clear view of the contents of the drawer and is also useful for example in a situation where articles at the back of the drawer are relatively inaccessible or where the drawer is in a higher location. One advantageous use of the invention would be in a pharmacy and another would be in a kitchen.

I claim:

1. A container for storing articles in a readily accessible manner, comprising:

an open ended channel shaped cabinet body having a bottom and two side walls, and rail means upstanding from said cabinet body bottom and extending longitudinally thereof;

a drawer slidable in said cabinet body on said rails and having a front end, a back wall, a bottom, and side walls upstanding from the bottom; and cooperating pivoting means located near the front of said cabinet body and the rear of said drawer to permit a hinging-like rotation of the drawer on the body, whereby to enable the drawer to hang downwardly from the front end of said body for article handling, said cooperating pivoting means comprising an upstanding, inwardly directed flange member at the front edge of each cabinet body side wall, and a ledge member extending beneath the drawer bottom and outwardly of each of the drawer side walls, said flanges and ledges cooperating to permit said hinging-like rotation, to enable said drawer to hang substantially vertically downwardly.

2. A container as claimed in claim 1 including means mounted on said drawer for retaining the articles stored therein.

3. A container as claimed in claim 2 in which the articles are cylindrical and the retaining means comprises a plurality of resilient article retaining inverted U-shaped rib members each bridging said shallow side walls and upstanding therefrom and spaced therealong from said back wall at intervals approximately the diameter of a selected cylindrical article to be retained in the drawer and spanning said drawer at a height above the bottom thereof slightly less than the diameter of the selected cylindrical article, whereby to provide a series of article receiving open pockets along said drawer, the rib defining the pocket adjacent the back wall being spaced therefrom a distance slightly less than the diameter of the selected cylindrical article, the front end of the drawer having an inturned lip.

4. A container as claimed in claim 3 in which said rib members are wires with substantially flat tops and depending side arms having inturned free ends, the side walls having apertures to receive said free ends.

5. A container as claimed in claim 4 in which the rib member side arm receiving apertures are located along the outside of said drawer shallow side walls to permit variation in the spacing interval between rib members.

6. A container as claimed in claim 5 in which said side arm receiving apertures are located at varying depth distances in the side walls above the bottom of the drawer whereby to vary the height of the ribs thereabove.

7. A container as claimed in claim 3 in which a finger slot is formed in an outer face of said drawer front end by said inturned lip.

8. A container as claimed in claim 1 in which said cabinet body is provided with upstanding hook members and cooperating hook member receiving slot members to permit a plurality of containers to be stored, one connected to a container above.

9. A container as claimed in claim 1 wherein said bottom of said drawer is divided in two by a centrally extending slot.

10. A container for storing cylindrical articles in a readily accessible manner, comprising an open ended channel shaped cabinet body having a bottom and two side walls; a drawer slidable in said cabinet body, said drawer having a front end with an inturned lip, a back wall, a bottom, and shallow side walls upstanding from said bottom; a plurality of resilient article retaining inverted U-shaped rib members each bridging said shallow side walls and upstanding therefrom and spaced therealong from said back wall at intervals approximately the diameter of a selected cylindrical article to be retained in the drawer and spanning said drawer at a height above the bottom thereof slightly less than the diameter of the selected cylindrical article, whereby to provide a series of article receiving open pockets along said drawer, the rib defining the pocket adjacent the back wall being spaced therefrom a distance slightly less than the diameter of the selected cylindrical article; and cooperating pivoting means near the front of said cabinet body and the rear of said drawer to permit a hinging-like rotation of the drawer on the body, whereby to enable said drawer to hang downwardly from the front end of said cabinet body for article handling, said cooperating pivoting means comprising an upstanding, inwardly directed flange member at the front edge of each cabinet body side wall, and a ledge member extending beneath the drawer bottom and outwardly of each of the drawer side walls, said flanges and ledges cooperating to permit said hinging-like rotation, to enable said drawer to hang substantially vertically downwardly.

11. A container as claimed in claim 10 further comprising rail means upstanding from said cabinet body bottom and extending longitudinally thereof to support said drawer when in the cabinet.

12. A container as claimed in claim 11 in which said rail means has a downwardly curved ramped-end adjacent the front of said cabinet body to assist said hinging-like rotation.

13. A container as claimed in claim 12 in which said rail means comprises a pair of rail members transversely spaced on said body bottom.

14. A container as claimed in claim 10 in which said rib members are wires with substantially flat tops and depending side arms having inturned free ends, the side walls having apertures to receive said free ends.

15. A container as claimed in claim 14 in which the rib member side arm receiving apertures are located along the outside of said drawer shallow side walls to permit variation in the spacing interval between rib members.

16. A container as claimed in claim 15 in which said side arm receiving apertures are located at varying depth distances in the side walls above the bottom of the drawer whereby to vary the height of the ribs thereabove.

17. A container as claimed in claim 10 in which said cabinet body is provided with upstanding hook members and cooperating hook member receiving slot members to permit a plurality of containers to be stored, one connected to a container above.

18. A container as claimed in claim 10 in which a finger slot is formed in an outer face of said drawer front end by said inturned lip.

19. A container as claimed in claim 10 wherein said bottom of said drawer is divided in two by a centrally extending slot.

* * * * *